United States Patent [19]

Redemann

[11] 4,190,002

[45] Feb. 26, 1980

[54] WORKPLACE EQUIPMENT

[75] Inventor: Peter Redemann, Berlin, Fed. Rep. of Germany

[73] Assignee: Schering, A.G., Berlin and Bergkamen, Fed. Rep. of Germany

[21] Appl. No.: 894,446

[22] Filed: Apr. 7, 1978

Related U.S. Application Data

[62] Division of Ser. No. 667,117, Mar. 15, 1976.

[51] Int. Cl.[2] ..... A47B 37/00

[52] U.S. Cl. ..... 108/50; 108/101

[58] Field of Search ..... 108/50, 101, 109, 92, 108/107, 159; 297/172, 423; 312/195, 194, 235 R, 223

[56] References Cited

U.S. PATENT DOCUMENTS

| | | | |
|---|---|---|---|
| 1,858,103 | 5/1932 | Menon | 297/172 X |
| 2,107,404 | 2/1938 | Wilkin | 312/223 X |
| 2,757,996 | 8/1956 | Kozelka | 108/101 |
| 3,770,334 | 11/1973 | Weber | 312/194 |
| 3,834,325 | 9/1974 | DeWilde | 108/109 |
| 3,883,202 | 5/1975 | Konig | 312/195 |

*Primary Examiner*—Francis K. Zugel
*Attorney, Agent, or Firm*—Millen & White

[57] ABSTRACT

To facilitate manual operations, especially in the pharmaceutical industry, there are provided for cooperation with a conveyor belt, particularly designed worktables, a service rack, and an adjustable table having an angle member.

2 Claims, 15 Drawing Figures

WORKPLACE EQUIPMENT

This is a division, of application Ser. No. 667,117, filed Mar. 15, 1976.

BACKGROUND OF THE INVENTION

The present invention relates to a workplace equipment, especially for manual working places in the industrial manufacture. This equipment comprises a worktable, a worktable for belt conveyors, an adjustable table with an angle plate, a service rack, and a chair, all of which can be utilized in unison or individually, depending on the requirements of the working process.

In the industry, workplaces are made available, in part, with the objective in mind of providing a maximally economical manufacturing procedure. However, the equipment of these workplaces is frequently designed without consideration of findings obtained in work physiology and work psychology, whereby the desired working efficiency could not be attained. In some branches of industry, as in the pharmaceutical industry, the basic rules of the World Health Organization demand a high quality of workplace equipment.

It is an object of the present invention to provide workplace equipment which fully satisfies the findings obtained in work physiology and work psychology and complies with legal requirements.

Upon further study of the specification and appended claims, further objects and advantages of this invention will become apparent to those skilled in the art.

SUMMARY OF THE INVENTION

One object of this invention is attained by providing that the workplace equipment comprises a worktable, a worktable for belt conveyors, an adjustable table with an angle plate, a service rack, and a chair.

The worktable comprises two end sections; the lower zone of these end sections comprises mounting rungs worked into these sections for a height-adjustable footrest. The two end sections are connected with each other by tubes, and the working surface is loosely laid thereon and held by means of stop blocks.

The worktable for belt conveyors comprises two end sections; in the lower zone of the latter, mounting rungs are provided for a vertically adjustable footrest. The two end sections are connected with each other by tubes. In the upper, stepped portion of the table there is arranged, beside the table plate held by stop blocks, a free space for receiving a conveying means. At the rearward longitudinal tube, a tripod is detachably mounted with a tripod head, the latter carrying by way of two parallel, movable rods, an angle plate having a form similar to a reading desk.

The adjustable table with the angle plate comprises a bottom frame, two end sections with receiving rungs for a vertically adjustable footrest, these sections being joined by tubes and carrying at the tips a guide bar receiving a top frame which is vertically adjustable by spacer elements. The top frame comprises an inverted pipe with a rectangularly attached frame with a table plate, wherein the latter can be erected optionally with the aid of a supporting rod, and a loose table angle plate can be clamped thereto at any desired height.

The service rack comprises a base frame which is made mobile by means of casters and is composed of a rectangular frame with an outwardly extended rim and three tubes in the longitudinal axis. A steering beam with a drawbar is attached to the middle tube. The service rack furthermore consists of an attachment which can consist of a frame and two tubes in the longitudinal direction and which can be composed of several independent attachments, for example three of them, and the rack further comprises a top panel with stop blocks.

The chair comprises a five-legged base with casters and a seat with a resiliently mounted backrest, wherein the seat/backrest combination is pivotably resilient in all directions.

Additional details of the invention will be explained and described in greater detail with reference to an embodiment, wherein reference is had to the appended drawings.

FIG. 1 shows a worktable in a perspective view;

FIG. 1*a* shows the corner joints pertaining to the worktable and a stop [locking] block;

FIG. 2 shows a worktable for belt conveyors in a perspective view with the tripod angle plate attached thereto, wherein the working panel which can be placed on the structure in place of the tripod, if desired, is indicated;

FIG. 2*a* shows details of the support structure for the demountable tabletop;

FIGS. 2*b* and 2*c* show details of the tripod, especially the tripod head and the framework with the working panel which can selectively be placed thereon;

FIG. 3 shows an adjustable table with an angle plate in a perspective view;

FIG. 3*a* shows the fixing clamp for the loose angle plate;

FIG. 3*a*′ shows the bottom frame of the adjustable table in a cross-sectional view;

FIG. 3*b* shows the top frame of the adjustable table, wherein the adjusted (inclined) position of the working panel (top) is indicated;

FIG. 3*b*′ shows the loose angle plate in the unfolded position;

FIG. 4 shows the services rack;

FIG. 4*a* shows a caster which can be attached;

DETAILED DESCRIPTION

Figure 1:
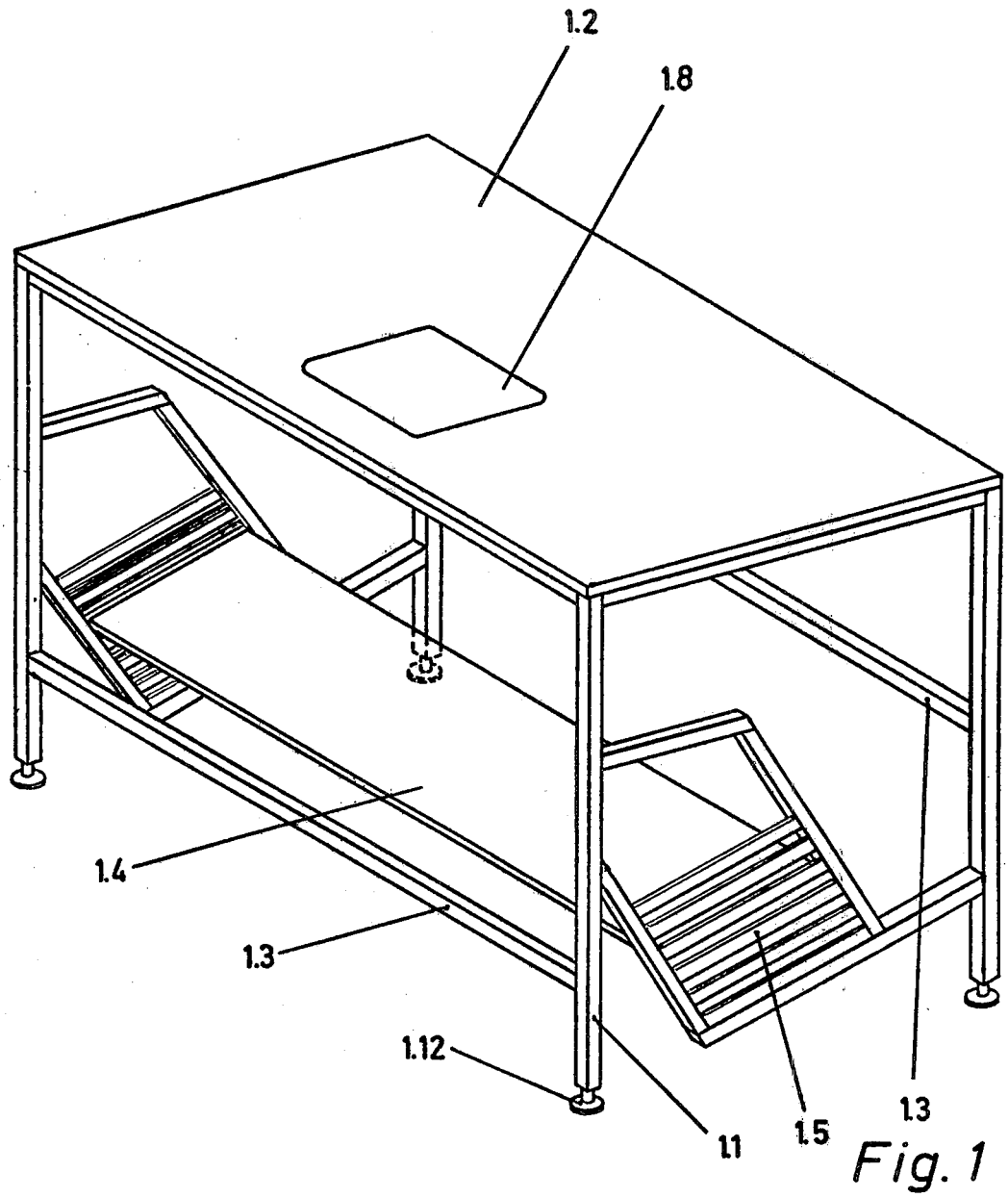
Figure 1B:
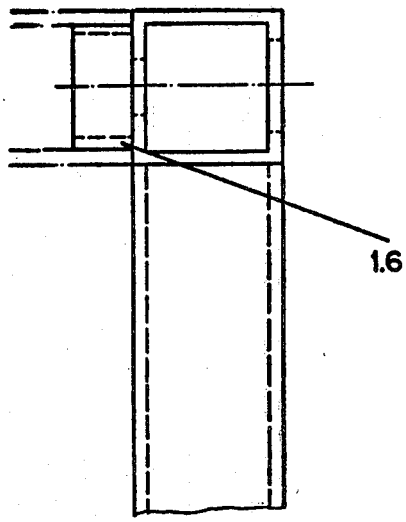
Figure 1C:
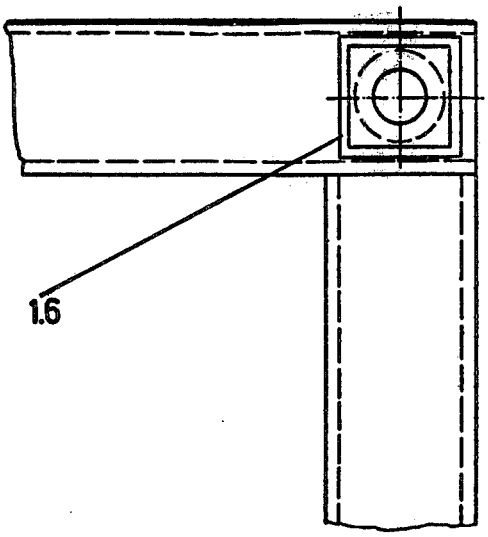
Figure 1A:
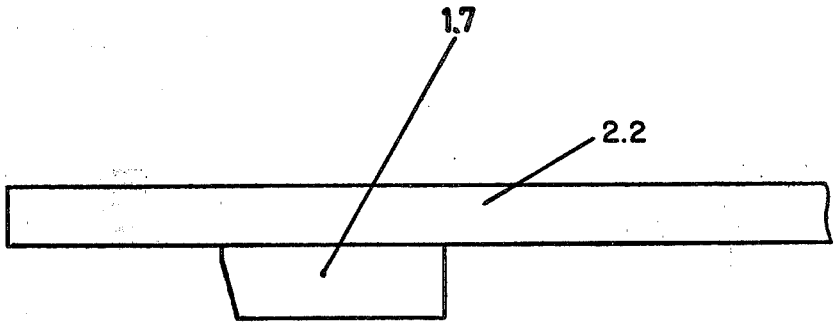

The worktable (FIG. 1) comprises two end sections 1.1; in the lower zone of the latter, mounting rungs 1.5 have been machined for the footrest 1.4 to place the latter in various vertically adjusted positions. The two end sections 1.1 are joined by tubes 1.3. The corner joints 1.6 are effected by screws (FIG. 1*a*).

A tabletop 1.2 is loosely laid on the mounted frame. The tabletop 1.2 is locked in place by means of stop blocks 1.7 (FIG. 1*a*). The surface of the tabletop has an area marker 1.8 centrally with respect to the length of the tabletop at a distance of about 100 mm. from the working edge. Levelling feet 1.12 are provided at the ends of the table feet.

Figure 2:
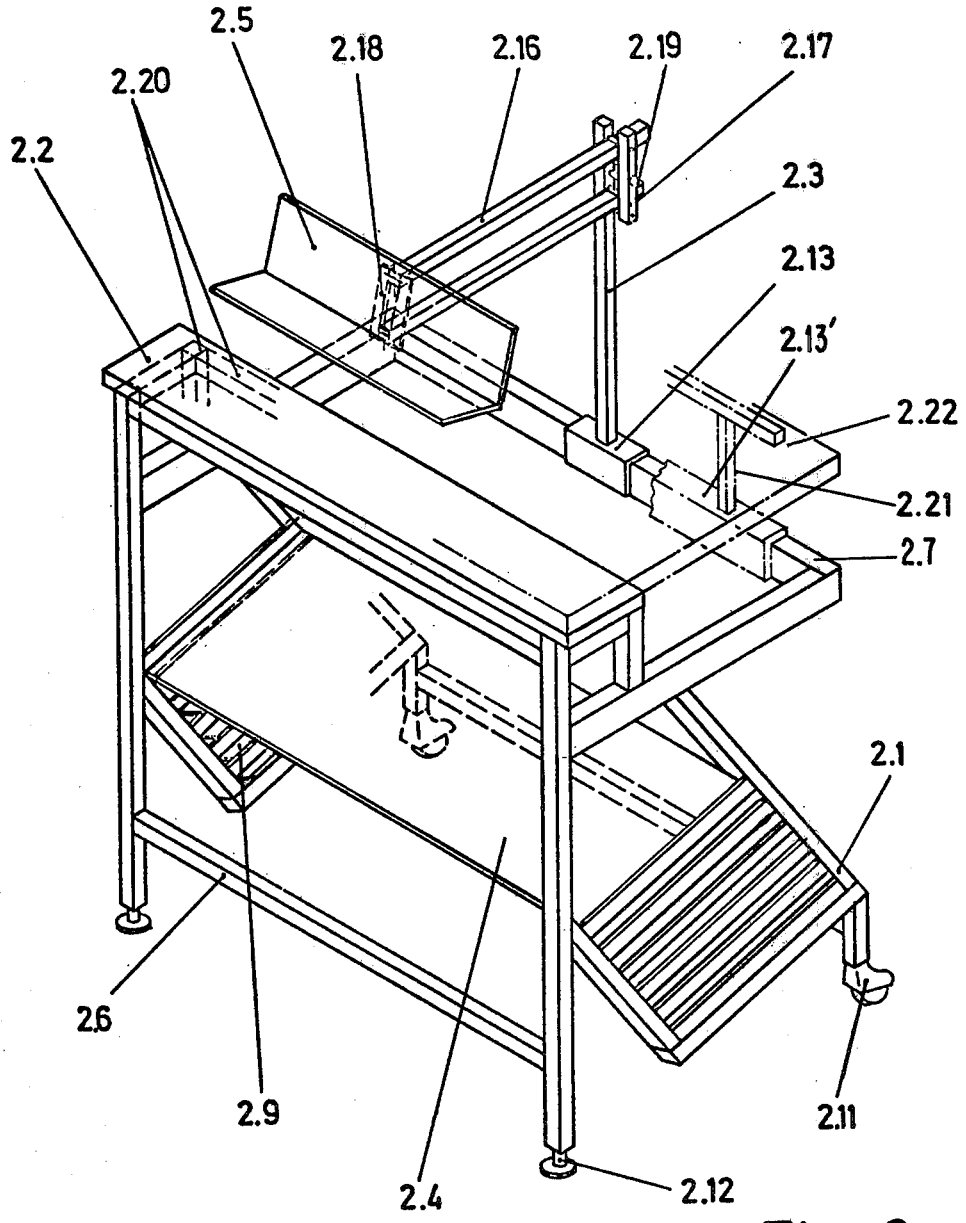
Figure 2B:
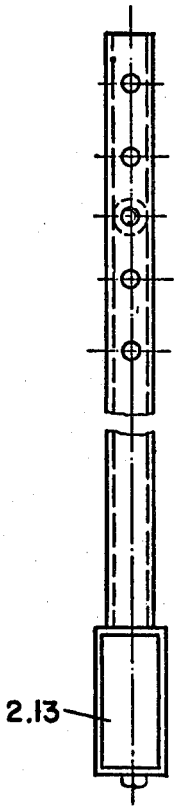
Figure 2C:
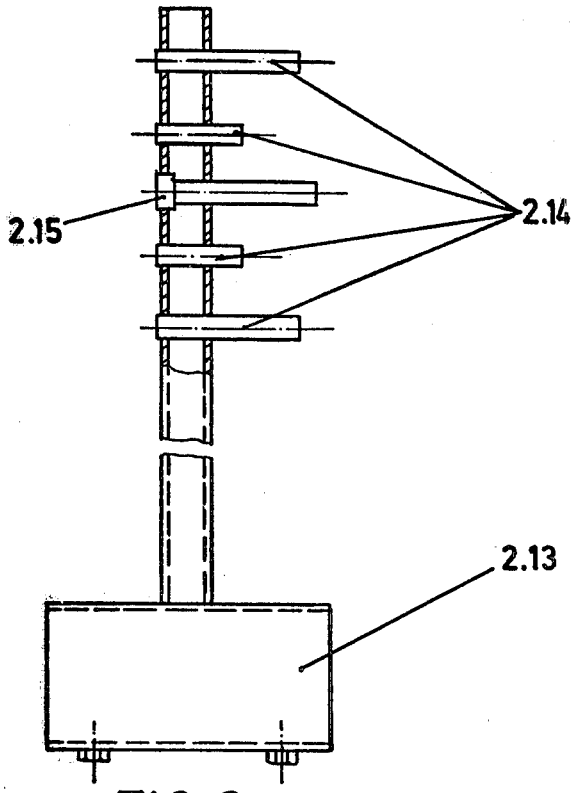

The worktable for belt conveyors according to FIG. 2 comprises two end sections 2.1; in the lower zone of the latter, a mounting 2.9 has been provided for various vertical positions of the footrest 2.4. The top part contains a step comprising a tabletop 2.2; stop blocks 1.7 are attached to the underside of this tabletop, holding the latter form-fittingly between the tubes 2.20. In the free space of the steps, a conveying means can be inserted to supplement the fixed working plane. The frame feet facing away from the seating edge have lockable casters 2.11. The table feet on the seating edge have levelling feet 2.12.

The two end sections 2.1 are joined by means of tubes, such as 2.6 and 2.7. The corner joints are effected by screws as in 1.6.

Figure 2A:
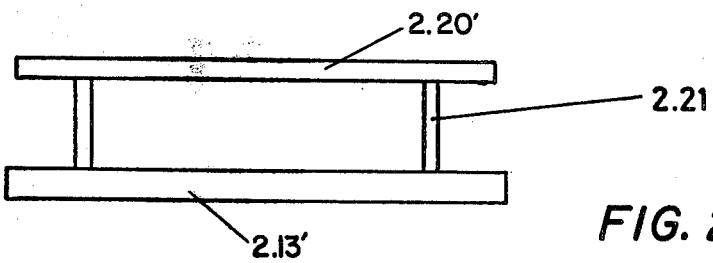

A fixedly clampable tube 2.13 is pushed onto the rearward connecting tube 2.7. A tripod column 2.3 is attached to the former tube. The tripod column 2.3 is equipped at its head end with guide pins 2.14 (FIG. 2*a*) and a centrally located threaded pin 2.15 (FIG. 2*a*). In the guide pins 2.14, two square tubes 2.16 are slidingly movable, an angle plate 2.5 being mounted to one end of these tubes. A tubular traverse 2.17 is placed over the guide pins 2.14 and the threaded pin 2.15 of the thus-formed tripod head, when the angle rods 2.16 are inserted. The ends of the angle rods 2.16 are rotatably mounted to the angle plate 2.5 with two angle sheets 2.18. By way of a handwheel 2.19, serving as the nut, the traverse 2.17 is pressed onto the angular rods 2.16, thus fixing the parallelogram consisting of rods 2.16, angle member 2.5, and tripod head.

The tripod system 2.13, 2.3-2.5 can be exchanged for a structure 2.21 (FIG. 2*a*) bridging the table gap between the planes of the tube 2.7 and the tubes 2.20. This structure 2.21 comprises four tubes connected with one another in the manner of a ladder and makes it possible to mount the tabletop 2.22. Tube 2.13' therein is similar to tube 2.13 in cross-sectional shape so as to fit on cross number 2.7.

The adjustable table with the angle member comprises a bottom frame, a top section with a spacer element 3.4, and a loose angle member 3.7.

Figure 3:
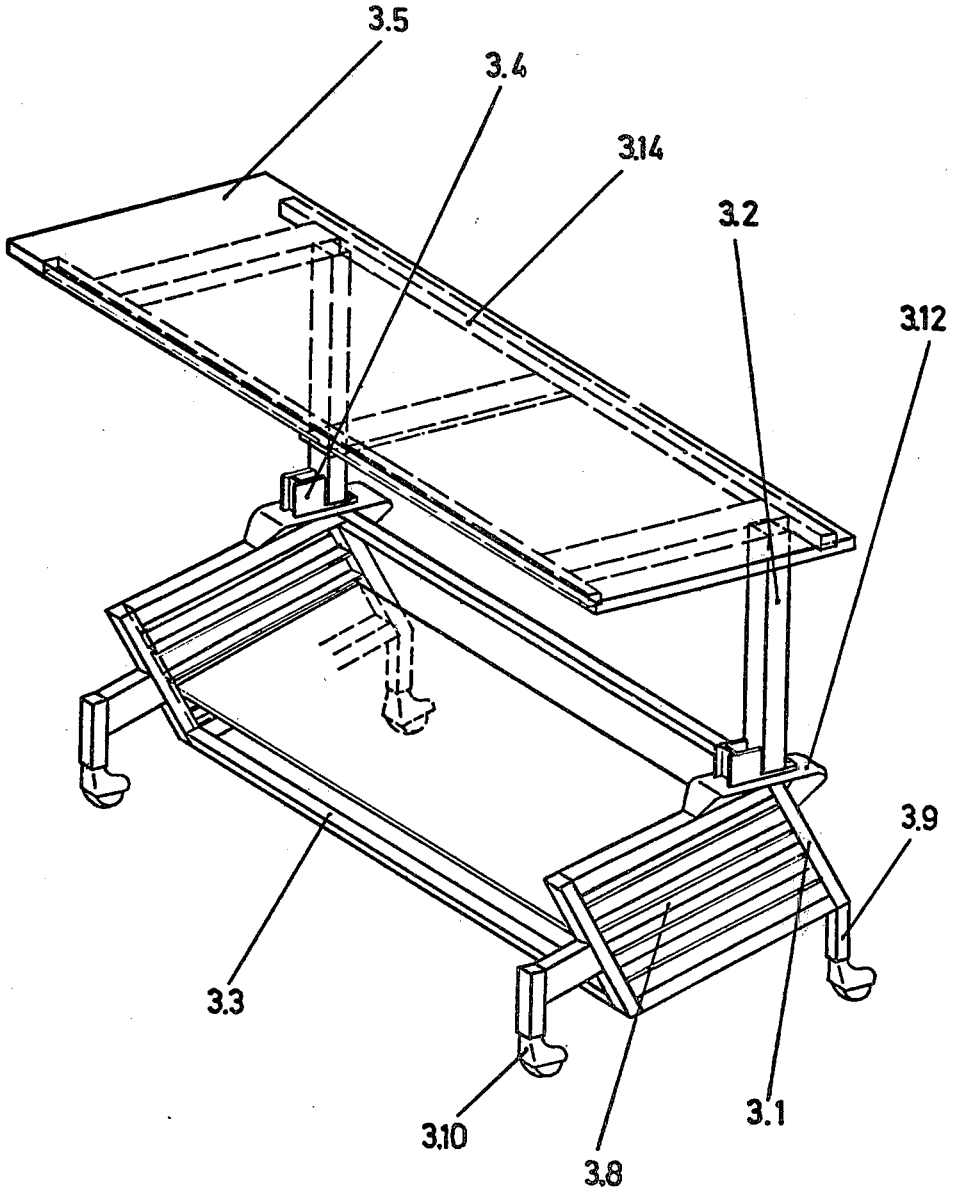
Figure 3A:
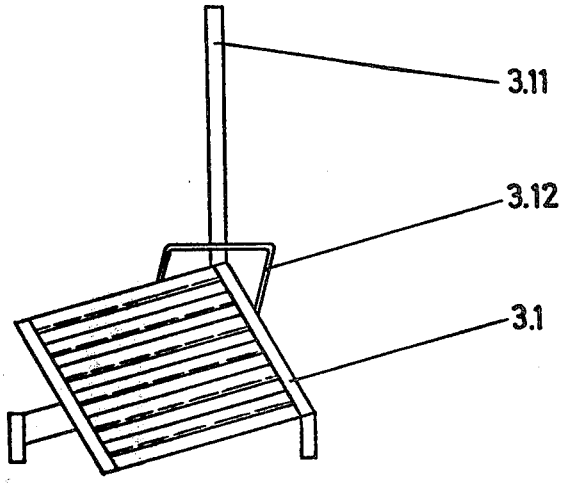
Figure 3A:
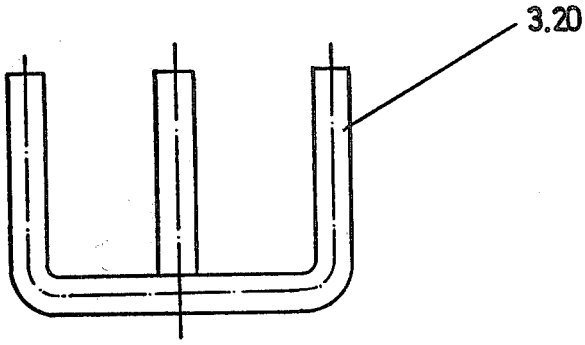

The bottom frame (FIG. 3*a*) is composed of two end sections 3.1. Each end section 3.1 is formed from the mounting of the vertically adjustable footrest 3.8 to which are attached respectively two feet 3.9 with lockable casters 3.10 and a guide rod 3.11. The mounting 3.8 and the guide rod 3.11 are joined by a bracket 3.12. Both end sections 3.1 are combined by means of tubes 3.3.

Respectively one spacer element 3.4 is placed over the guide rods 3.11. The spacer element 3.4 permits the vertical adjustment of the top part, wherein it is horizontally shifted on the guide rod 3.11 in one direction while lying on the bracket 3.12.

By displacing the spacer element 3.4 into the bearing zone of the inverted tubes 3.2 of the top part, the latter is elevated by this distance. Thus, the adjustable table with its tabletop 3.5 can be moved into the working zone of the worktable 1 (FIG. 1).

The top part consists of two insert tubes 3.2 placed over the guide rods 3.11 of the bottom frame. The insert tubes 3.2 are joined with each other by a square tube frame 3.14. The tabletop 3.5 rests on the tube frame.

Figure 3B:
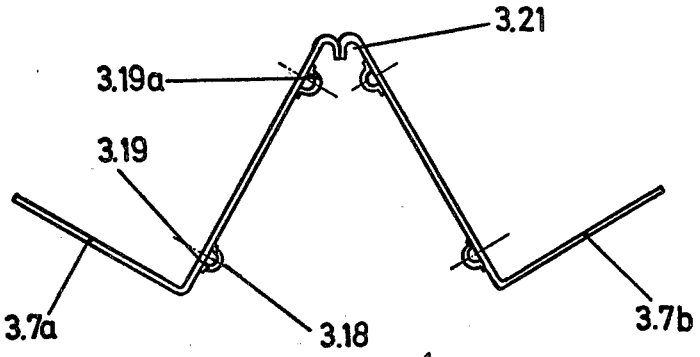
Figure 3B:
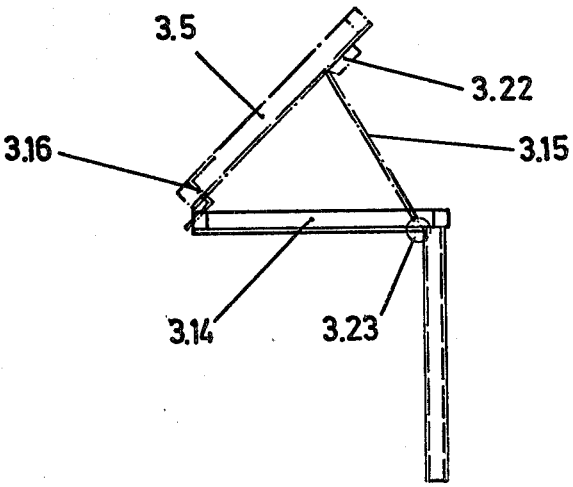

The tabletop 3.5 can be held by way of a supporting rod 3.15 (FIG. 3*b*) on a longitudinal side of the frame and can be brought, on the other longitudinal side of the tube frame 3.14, into variable inclined positions and fixed therein by means of two Z-angles 3.16 serving as the hinge. The supporting rod 3.15 is rotatable about the hinge element 3.23 at the tube frame 3.14. The locking block 3.22 at the tabletop 3.5 serves for fixing the inclined tabletop 3.5 in its position.

The loose angle plate 3.7 (FIG. 3*b*) comprises two equally long sheet-metal angle halves 3.7*a* and 3.7*b* which together attain the length of the tabletop 3.5. The central dividing seam is joined form-fittingly by two cylindrical pins 3.18 mounted in shackles 3.19 attached on each angle half 3.7*a* and 3.7*b*. The thus-composed angle plate 3.7 comprises, at the two upper outer sides at the level of the top shackle 3.19 of the central dividing seam, likewise a shackle 3.19*a* of the same dimensions. Clamps with three teeth and denoted by 3.20 (FIG. 3*a*) can be inserted in these shackles 3.19*a*. The angle plate 3.7 can be clamped to the inclined tabletop 3.5 in any desired height position by means of this clamp 3.20. If both angle halves 3.7*a* and 3.7*b* are disassembled and placed against each other with the upper folded border 3.21, a bilateral angle of half the table length is obtained. The three-toothed clamp 3.20 is inserted in the upper shackles 3.19*a* of both angle halves 3.7*a* and 3.7*b* and thus prevents the spreading apart of the angle plate 3.7.

Figures 4, 4A:
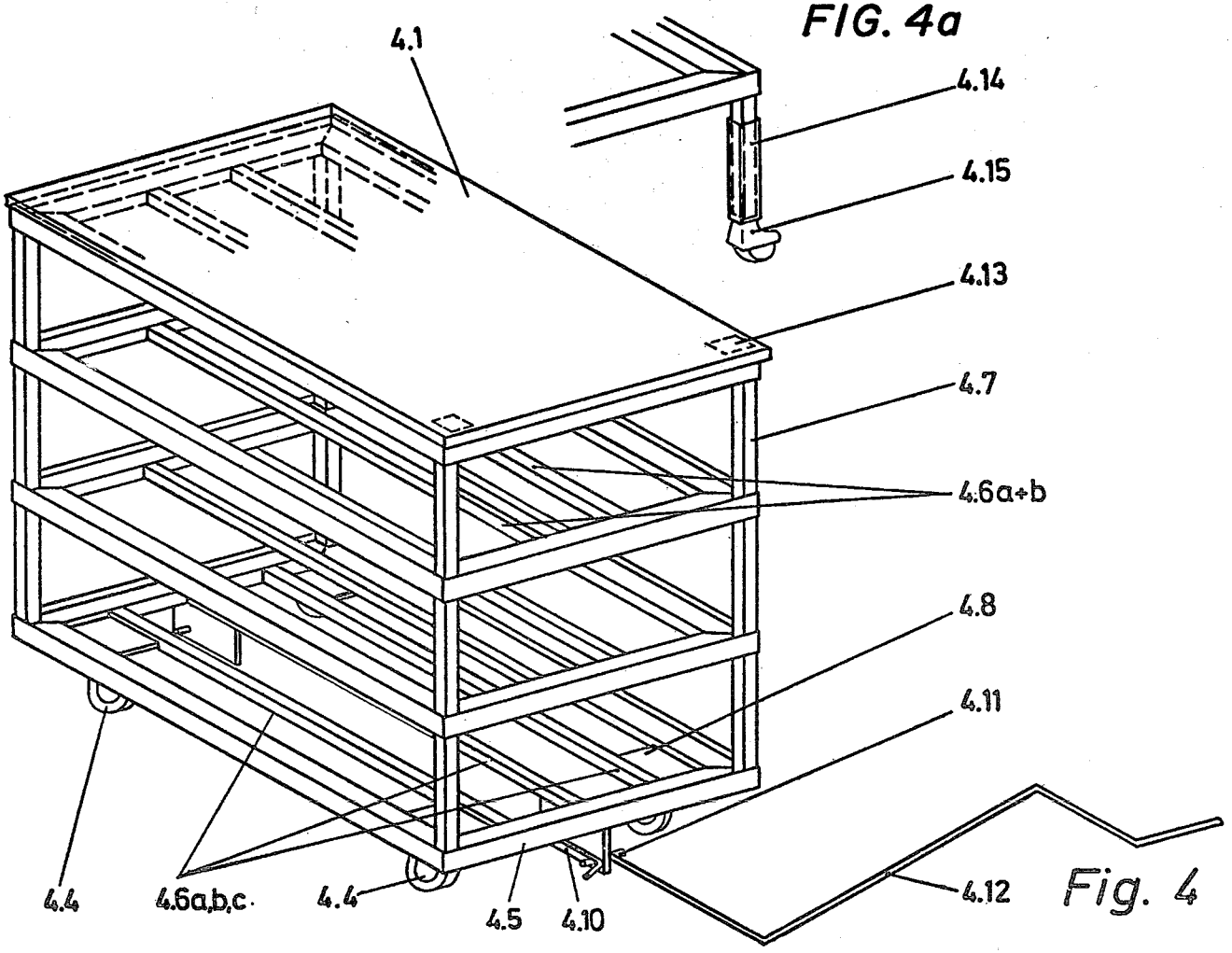

The service rack (FIG. 4) comprises a movable base frame, an attachment, and the top panel 4.1 as well as the insertable casters 4.14 and 4.15.

The base frame consists of a rectangular frame 4.5 made of rectangular tubing with an elevated rim, wherein the latter delimits the outside of the frame.

Three square tubes 4.6*a, b, c* are inserted in this frame 4.5 in the longitudinal axis. The two square pipes 4.6*a* and 4.6*c* define, on the outside, the base panels 4.8 to which the fixable casters 4.4 are attached. The central pipe 4.6*c* carries the steering beams 4.10. The steering beam 4.10 is provided with a bilaterally projecting pin 4.11 on which rests a drawbar 4.12 making it possible to steer the base frame accurately in a desired direction.

The frame 4.5 of the attachment comprises the same material and has the same dimensions as the base frame. In contrast to the latter, however, it has only two central tubes 4.6*a* and 4.6*b* arranged in the longitudinal axis. The frame has four feet 4.7 of square tubing. The feet of one attachment can be inserted in the respectively lower-disposed attachment into the base frame or into the insertable casters 4.4. The attachment is preferably used in the form of three separate attachments with central tubes 4.6*a* and 4.6*b*.

The top panel 4.1 can be loosely placed on the base frame and/or on the attachment and is secured from sliding off by means of locking elements 4.13.

The insertable casters 4.4 consist of a square pipe 4.14, one end of which carries a fixable guide roller 4.15. The open pipe end can be placed over a foot 4.7 of the attachment.

Figure 5:
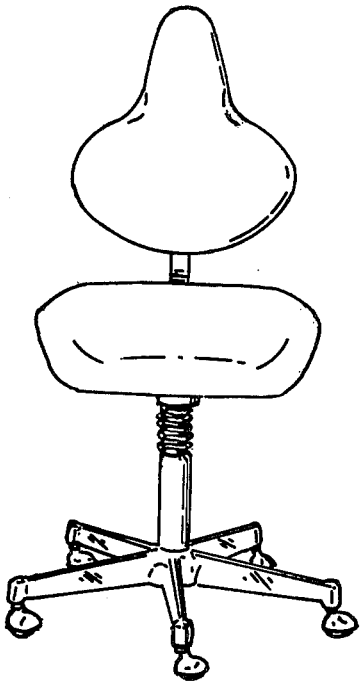
FIG. 5 shows a front view of the chair.

The chair (FIG. 5) as used in the workplace equipment according to this invention is a model known per se. This chair consists of a base frame with five arms each of which carries a pivoting roller. The seat is shaped anatomically. This seat is connected to a backrest permitting a large free space for motion during use, even if the person sitting on the chair leans against the backrest.

The seat is pivotably resilient, together with the backrest, toward all directions.

The individual parts of the workplace equipment of this invention have, in particular, the following functions:

The worktable (FIG. 1) serves as a stationary working zone for manipulations such as, for example, the composing of individual parts or for rearranging.

The worktable for belt conveyors (FIG. 2) is intended as a fixed working zone for manipulations on mechanical conveyor stations, such as belt conveyors or roller chains. This table can be introduced underneath a belt conveyor at any desired location.

The associated tripod angle member (FIG. 2*a*) can be moved vertically within the limits of the parallelogram toward the front or rear, upwardly or downwardly, wherein the inclination of the angle plate is likewise movable.

By means of the attachment frame 2.21, which can be attached in place of the tripod angle, a worktable is obtained which fits in its dimensions to all other parts of the workplace equipment according to the present invention.

The adjustable table with angle plate (FIG. 3) supplements the fixed working zone of the worktable (FIG. 1) when the tabletop is horizontal and has been lowered. With an obliquely adjusted working top with the top part being elevated and the loose angle plate clamped in position, the material to be worked on can be moved toward the personnel and away from the personnel over the worktable panel.

The loose angle member 3.7 can be utilized with half its length and with bilateral extension separately from the adjustable table at any worktable top.

The service rack can be used without the top panel 4.1 as well as with this top panel 4.1.

When used without the panel 4.1, the rack serves as transport vessel for the conveyance of packaging components from and to the working station, as a storage container at the working place, for the supply of individual parts during the assembly of packaged units in the working zone of the collaborator, for receiving auxiliary devices and for making possibilities available for using the latter during changing working locations in the working zone of the collaborator.

When used with the panel 4.1, the latter serves as an extension for the worktable with simultaneous utilization of the space underneath the panel for storage; the panel represents the worktable extension and the conveying means, and the service rack serves as vertically adjustable stand during fixed and mobile use at any site of the manufacturing process.

Figure 6:
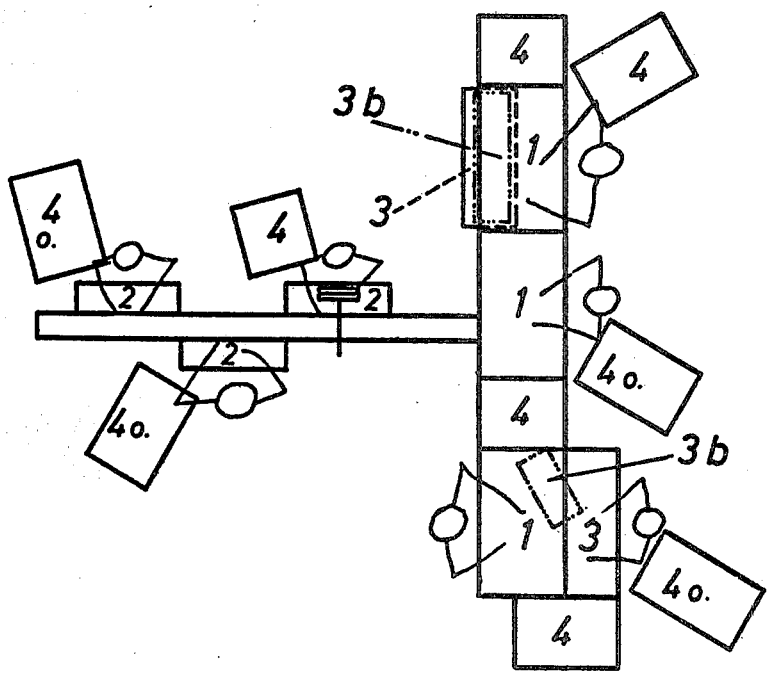
FIG. 6 shows the use of the workplace equipment of this invention in connection with the example of a final stage in the packaging process for small components.

FIG. 6 shows as an example how the individual parts of the workplace equipment can be utilized in combination.

By way of the conveyor belt, ampoules are fed to the working stations at the tables for belt conveyors 2. These ampoules are here provided with further packaging components and returned to the belt. To present the parts, one-tier and/or two-tier service racks 4, with and without a panel 4.1 placed thereon, are located beside these stations.

From the belt, the preliminarily assembled units pass to the worktable 1. Here, they are further completed with the aid of packaging components made available at the worktable 1 with the adjustable table 3 with inclined table top 3.5 and attached angle plate 3.7 being pushed thereunder. The angle member 3.7 as well as the two service racks 4 serve for storing components so that they are readily accessible during the manufacturing process. The preliminarily assembled units then move via a service rack 4 with panel 4.1 as the buffer means to the worktable 1 with an adjustable table 3 placed thereagainst. The preassembled units are here packed into cartons. The loose angle member 3.7 standing on the tabletop 1.2 serves for presenting the parts so that they can be readily seized. The units, once packaged into cartons, are placed on the lateral service rack 4 and moved to the pallet.

The workplace equipment of this invention is tailored especially for the needs of the pharmaceutical industry without being limited thereto. The workplace equipment in accordance with this invention prevents, in pharmaceutical final-stage manufacturing plants, in a simple manner any contaminations, erroneous interchanging, and/or intermixing according to the basic rules of the World Health Organization (WHO) for the production of medicinal agents and safeguards the quality of the products as also set out in the new version of the German drug law.

None of the parts of the workplace equipment of this invention show, in the assembled condition, any open pipe locations or threads. The parts closing off the tubes can be detached in the disassembled condition. Thereby, the components can, if necessary, be cleaned off in the internal spaces of the profiles in accordance with the material. Due to the fact that the equipment can be disassembled, all of the individual components can be advantageously cleaned in correspondence with the respective peculiarity of the material. The workplace equipment of this invention permits a minimum movement of material for the prevention of contaminations, erroneous interchanges, and intermixing. The equipment is constructed so that it can be rapidly adapted without modifications to varying manufacturing procedures in order to attain an increased safety for the preparations. Cleaning devices can easily be inserted underneath the fixed parts, such as the worktable, for example, and mobile components, such as the service rack, can easily be removed from the group of furniture for janitorial cleaning purposes.

All of the parts can be disassembled, stacked, and placed on pallets.

At all tables of the workplace equipment, it is possible to selectively be in a seated or standing position under ergonomically identical conditions, so that starting with the work in progress and the motion elements derivable, therefrom, the workplace equipment is optimally constructed according to the REFA tables of anthropometry for 95% of all women living in the Federal Republic of Germany. In the workplace equipment according to this invention, the measurement ratios of the human body, the economical utilization of the muscle power, the visual power, and also psychological viewpoints for arranging a working place, such as, for example, the rules of motion economy, have been taken into account.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A worktable for belt conveyors (2) comprising two end sections (2.1), in the lower zone of which there are provided mounting rungs (2.9) for a vertically adjustable footrest (2.4) and which are connected by tubes (2.6) the top part of the table containing a step comprising a tabletop (2.2) with stop blocks (1.7) attached to the underside, said blocks holding said tabletop between tubes (2.20) extending between said end sections, a free space being provided beside said tabletop (2.2), for receiving a conveying means; said free space being bounded by a rearward longitudinal tube (2.7) connected between said end sections and wherein a second tabletop (2.22) is removably positioned in said free space supported on structure attached to said rearward tube (2.7).

2. A worktable according to claim 1, wherein, when said second tabletop (2.22) is removed, a tripod (2.3) with a tripod head is removably mounted on said rearward longitudinal tube (2.7), an angle member (2.5) similar to a reading desk being arranged at this tripod head by way of two parallel, movable rods (2.16).

* * * * *